US007497031B1

(12) United States Patent
Clary

(10) Patent No.: US 7,497,031 B1
(45) Date of Patent: Mar. 3, 2009

(54) AGRICULTURAL DRYING APPARATUS AND METHODS

(76) Inventor: Charles Revis Clary, P.O. Box 88, 3054 Cross Creek Blvd., Callahan, FL (US) 32011

( * ) Notice: Subject to any disclaimer, the term of this patent is extended or adjusted under 35 U.S.C. 154(b) by 440 days.

(21) Appl. No.: 11/307,389

(22) Filed: Feb. 5, 2006

Related U.S. Application Data

(60) Provisional application No. 60/593,693, filed on Feb. 6, 2005.

(51) Int. Cl.
*F26B 21/00* (2006.01)

(52) U.S. Cl. ..... 34/174; 34/233; 34/235; 34/218; 34/509; 34/510; 34/582

(58) Field of Classification Search ..... 34/171, 34/174, 179, 503, 507, 233, 235, 201, 218, 34/223, 224, 225, 582, 359, 360, 232; 298/24, 298/27, 28; 202/504, 505; 105/243, 422
See application file for complete search history.

(56) References Cited

U.S. PATENT DOCUMENTS 1,558,119 A * 10/1925 Sherban ..... 34/174
2,112,698 A * 3/1938 Hull ..... 222/505
3,052,176 A * 9/1962 Anderson ..... 454/253
4,118,875 A * 10/1978 Sietmann et al. ..... 34/174

* cited by examiner

*Primary Examiner*—Kenneth B Rinehart
(74) *Attorney, Agent, or Firm*—Jonathan Rigdon Smith

(57) ABSTRACT

An apparatus for enhanced drying of bulk agricultural products is provided in a transport trailer. The apparatus includes a perforated false bottom below the product, an air manifold buried within the product, and baffles for air distribution. Product unloading capabilities are enhanced as well. These capabilities enhance the uniformity and reproducibility of drying, ease of product handling, and greater safety in unloading the product.

16 Claims, 10 Drawing Sheets

Section A-A'

Section C-C'

Section D-D'

Section E-E'

AGRICULTURAL DRYING APPARATUS AND METHODS

This nonprovisional application for patent claims priority of provisional application Ser. No. 60/593,693 filed Feb. 6, 2005.

BACKGROUND OF THE INVENTION

The invention described in this application pertains mainly to the field of preserving agricultural products by drying. The principal means used to prevent spoilage of harvested grains, beans and legumes is removal of moisture as soon as practicable after harvest (or even on the stalk before harvest, as with corn). In locations and seasons where the ambient air humidity is low, the drying is often done simply by exposure to air. Thus, this invention also pertains to the field of air drying. It pertains more specifically to the field of forced warm air drying, because air drying may be augmented by preheating of the air, and by forcing the air through the material to be dried.

The invention pertains as well to transportation of agricultural products. Grains, beans, legumes, and tree nuts are typically transported after harvest in open-topped rectangular conveyances such as dump cars and box trailers. Box trailers are most commonly used for legumes such as peanuts. These trailers may be emptied by tilting or by positioning on a rollover dump apparatus. Hopper trailers may also be used, which, while being more expensive than box trailers, may be unloaded in a level position and therefore do not require expensive tilt or roll dump equipment.

Hopper cars and trailers may be modified as described below to dry, as well as transport, agricultural products. Additional modifications, also described further below, may also be made to improve the ease of unloading such containers in a level position by a redesign of the prior art slide or drop gates at the bottom of the hopper(s).

The drying and transporting functions have been combined in the prior art in peanut production by application of warm air through the sides or bottoms of trailers. This reduces handling, because the drying is attempted in the same container that is being used for transportation. The chief drawback, however, is that drying is not uniform. When air is applied to one or two openings in the side or bottom of a trailer to dry peanuts, for example, the path of the air through the peanuts is uneven. As a result, some zones within the trailer dry faster than others. The result is that some of the nuts are over-dried and some are under-dried with attendant quality variation and potential for spoilage.

SUMMARY OF THE INVENTION

This invention is a transportation trailer (or dump rail car) designed to dry a bulk agricultural product uniformly while it is in the trailer or car and allow it to be unloaded without tilting the trailer or car. It employs a manifold of perforated air pipes, perforated false bottoms, and dampers for changing the distribution of the air through the product. The principal object of the invention is to provide a trailer or rail car equipped for drying of bulk agricultural products with improved uniformity of drying. A second object of the invention is to provide the drying along with means for unloading in a level position. A third object of the invention is, by permitting unloading in a level position, to improve the safety of unloading by eliminating the requirement for tilting or roll dumping of the trailer. Yet another object of the invention is to combine drying characteristics and easier opening and closing features in an improved hopper and dryer gate structure.

There are in existence thousands of box trailers used or capable of use for transporting peanuts and other bulk agricultural products. When properly retrofitted, these trailers could perform more uniform drying as described above. Thus, it is another object of this invention to provide a means and method of retrofitting by which an existing box trailer can be converted into an agricultural product drying apparatus having uniform drying characteristics.

In the following description, the term "trailer" is used to describe the invention, but it is to be understood that the invention includes any substantially rectangular transport box such as a rail dump car. The invention includes also, as a separate embodiment, any apparatus installed in or on such existing box in accordance with this description.

In the remainder of the specification, peanuts are the material discussed. However, the intended use of the invention is for any air-permeable bulk product in need of drying. Peanuts are mentioned solely by way of example and not limitation.

DETAILED DESCRIPTION OF THE DRAWINGS

Figure 1:
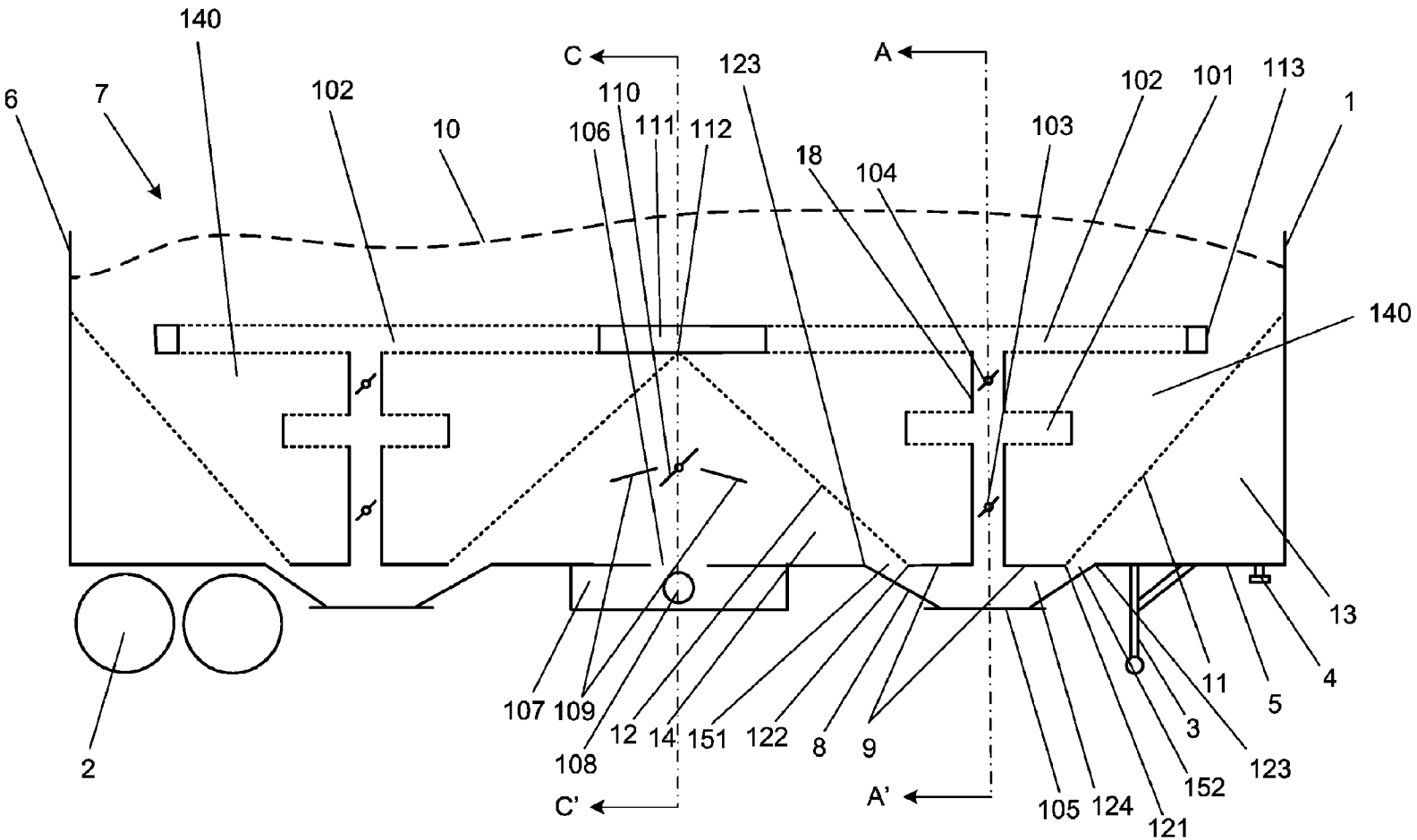
FIG. 1 is a side cutaway view of a first embodiment of the invention installed in a typical semi-trailer.

Referring now to the drawings, in which like reference characters refer to like features in the several drawings, FIG. 1 is a side cutaway view of a first embodiment of the invention installed in a typical, e.g., 48-foot, semi-trailer. In this and all of the other embodiments, the semi-trailer provides a box 1 having (typically) an eight-wheel undercarriage 2, landing gear 3 and a kingpin 4 for articulating attachment to a towing vehicle (not shown). Such a trailer has a flat floor 5, flat vertical sides 6, and an open top 7. The open top 7 may be covered (not shown) while the trailer is in motion, to prevent blow-off of product.

The components of the drying apparatus internal to the box 1 are essentially two identical halves, each of which is a mirror image of the other. Most of the essential detail of the invention is shown in the right half of FIG. 1. Right and center sloped perforated bottoms (dashed to indicate perforation, not environmental structure) 11 and 12, respectively, are fixed to sides 6 and floor 5, create a product-filled drying zone 140 with the perforations sized sufficiently smaller than peanuts to prevent peanuts from entering right space 13 or center space 14. Between the lower edges 121 and 122 of bottoms 111 and 12 respectively is a horizontal rigid product dryer gate 9. Rigid dryer gate 9 is shown in these drawings as a slide gate, but it may be a drop gate or similar without limitation. Below rigid dryer gate 9 is a hopper chute 8 to focus the flow of peanuts (represented by dotted level line 10) to a receiver below the trailer (not shown). A hopper gate 105 is provided to cover the lower end of the chute during the drying operation. Hopper gate 105 is shown in these drawings as a slide gate, but it may be a drop gate or similar without limitation. Hopper gate 105, chute 8, and rigid product dryer gate 9 define an air space 124.

Lower edges 121 and 122 of perforated bottoms 11 and 12, which meet the left and right edges of rigid product dryer gate 9, are between upper edges 123 of hopper chute 8, creating slots 151 and 152. These slots extend a substantial part of the entire width of floor 5 (into the page) and allow space 14 to communicate with space 13 through space 124. A circular hole 17 is cut into floor 5 and a vertical pipe 18 is welded into place above it. A like hole 17 is cut into rigid product dryer gate 9, so that when rigid dryer gate 9 is fully inserted, vertical pipe 18 can receive air from hopper air space 124. In this first embodiment, vertical pipe 18 is a header pipe that in turn branches into a lower perforated pipe 101 and an upper perforated pipe 102. Portions of vertical pipe 18 may also be perforated. The perforated pipes 101 and 102 are shown in dashed lines, not to indicate hidden or environmental structure, but to indicate the portions of the pipe length that are perforated.

Perforated pipes 101 and 102 are substantially horizontal. Lower perforated pipe 101 is shorter than upper perforated pipe 102 to take into account the lesser distance between right perforated bottom 11 and center perforated bottom 12 at the height of the lower perforated pipe 101. A lower damper 103 and an upper damper 104 are positioned within the vertical pipe 18, lower damper 103 being between hole 17 and lower pipe 101, and upper damper 104 being between lower perforated pipe 101 and upper perforated pipe 102. These dampers are intended to provide nearly 0 to 100% air flow control through the section of pipe in which they are installed.

Near section line C-C' a second hole 106 is cut in floor 5 and a plenum 107 is fixed underneath it to provide ingress of air to space 14. A source of drying air 108 is applied to plenum 107. Above hole 106 within space 14 are installed baffles 109, running across space 14 (into the page). Between the baffles 109, proximate to centerline C-C', is a middle damper 110, also running across space 14 (into the page). It is shaped so that when air enters hole 106, air can be blocked from moving between baffles 109 by rotating damper 110 fully clockwise. Because all of the air coming into the trailer through plenum 107 must go either through bottom 12 or slot 151 (or their mirror images on the other end of the trailer) the split of the air volume between the two can be varied by changing the position of middle damper 110. Similarly, air entering slot 151 will be apportioned between vertical pipe 18 and slot 152 depending on the positions of dampers 103 and 104 and the width of baffles 109. Air entering vertical pipe 18 will be proportioned between lower perforated pipe 101 and upper perforated pipe 102 depending on the positions of dampers 103 and 104 as well.

As alluded to earlier, the invention is bilaterally symmetrical about centerline C-C'. The two halves of the drying apparatus are connected by a non-perforated pipe 111 joined with upper perforated pipe 102 on either end of the trailer. Pipe 111 is supported at its center by the upper edge 112 of perforated bottom 12 (and its mirror image piece on the other end of the trailer). This pipe 111 allows free communication of air between the upper perforated pipes 102 at each end of the trailer without over-drying peanuts in drying zones 140. The air flow pattern through the peanuts in the vicinity of pipe 111 should be similar to the pattern rightward of upper pipe end 113, where the layer of peanuts to be dried is relatively thin on average and should be capable of being timely dried without the assist of the perforated pipe.

To use the invention after it is filled with product such as peanuts, it is parked and a supply of pressurized warm air is connected to plenum 107. Dampers 110, 103 and 104 are adjusted by hand wheels mounted outside the walls of the trailer (see FIGS. 2 and 3) to provide uniform product moisture levels throughout the trailer. Typically, once the hand wheels have been set they should provide repeatable satisfactory uniformity of dryness for a given product. After drying, hopper gate 105 is opened, followed by rigid product dryer gate 9, allowing peanuts to flow downward onto an aspirator pad or the like.

In all of the embodiments described here, hand wheels or levers are mentioned as means for adjusting the dampers, depending on their location on the tested prototypes. It is to be understood that hand wheels, levers, or any other means of moving the dampers may be employed in this invention without limitation.

Alternatives to any of the described embodiments of the invention are meant to include hand wheel or lever indicia, and settings for same may be established by experimentation for various products and various seasons and localities as appropriate. Still other alternative embodiments of any of the described embodiments of the invention employ mechanical or electronic timers, psychrometers, and/or programmable logic controllers to position the dampers automatically.

Another alternative of the first embodiment of the invention utilizing a shorter trailer (not shown) involves only the apparatus shown in the right half of FIG. 1. This is equivalent to shifting a trailer side 6 to centerline C-C'. Damper 110 and baffles 109 are not needed, and plenum 107 and its appurtenances are shifted rightward so that all air supplied to the invention enters space 14.

Figure 2:
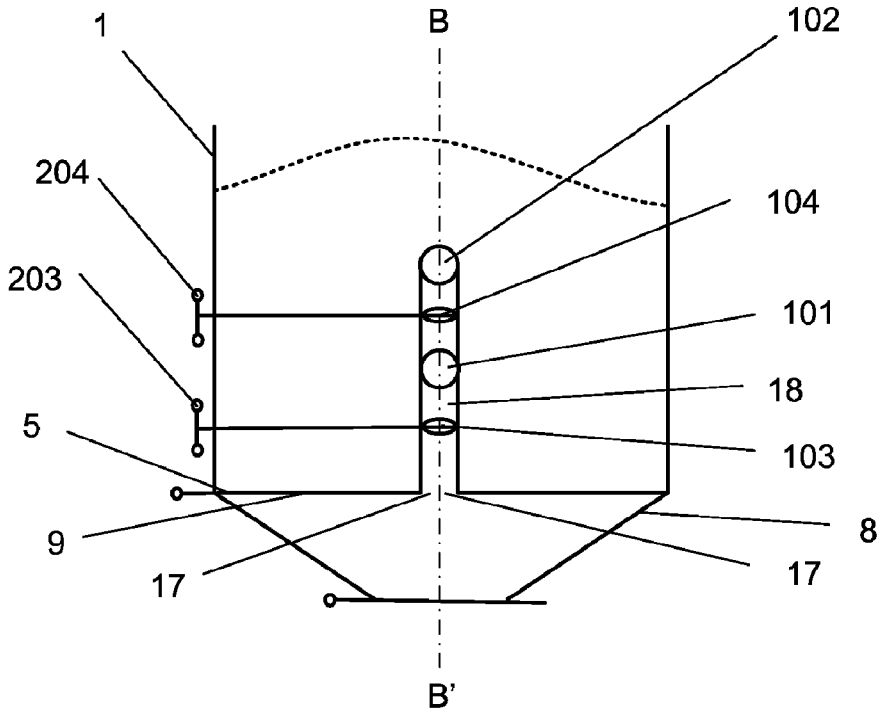
FIG. 2 is section view A-A' of the first embodiment.

FIG. 2 is a section view of the first embodiment at section A-A' of FIG. 1. It shows that vertical pipe 18 is located substantially at longitudinal centerline B-B' of box 1. Pull handle 200 allows rigid product dryer gate 9 to be withdrawn after drying is complete. Lower hand wheel 203 and upper hand wheel 204 are shown mechanically connected to upper and lower dampers 103 and 104, respectively. This end view shows that hopper chute 8 has sloped sides viewed end-on as well as from the side as in FIG. 1.

Figure 3:
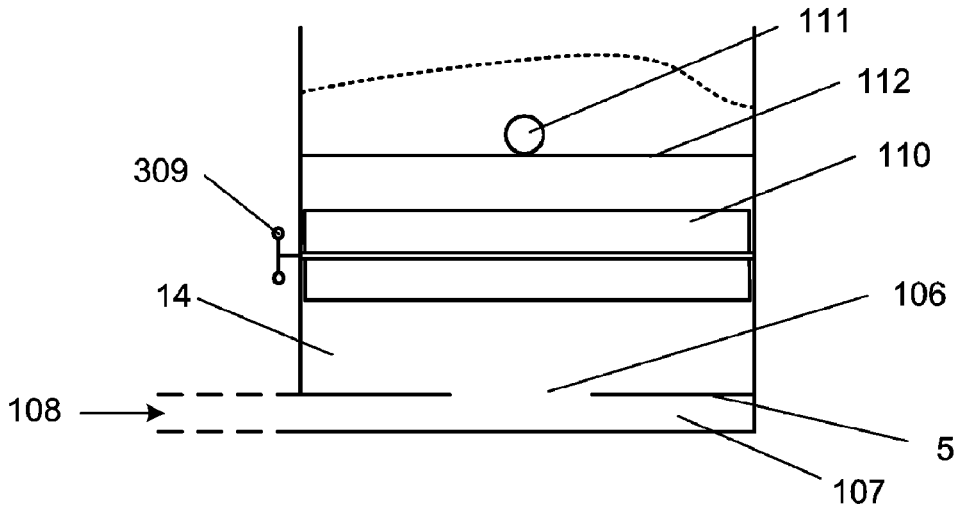
FIG. 3 is section view C-C' of the first embodiment.

FIG. 3 is a section view of the first embodiment at section C-C' of FIG. 1. Note that upper edge 112 of perforated bottom 12 is shown supporting non-perforated pipe 111. Center hand wheel 309 is shown mechanically connected to middle damper 110. Damper 110 is shown extending all the way across space 14. Air 108 is shown entering plenum 107 from the left. Because space 14 is relatively large, the exact shape and location of air supply 108, plenum 107, and entry hole 106 into space 14 is not critical. Air entry from the bottom or from the side of the trailer is acceptable as long as the air has unobstructed access to space 14 and enters the area of damper 110 and baffles 109 (not shown) from below. An alternative embodiment of the invention has an alternative supply of air (not shown) entering from either or both ends of the trailer into space 14 instead of, or in addition to, plenum 107.

Figure 4:
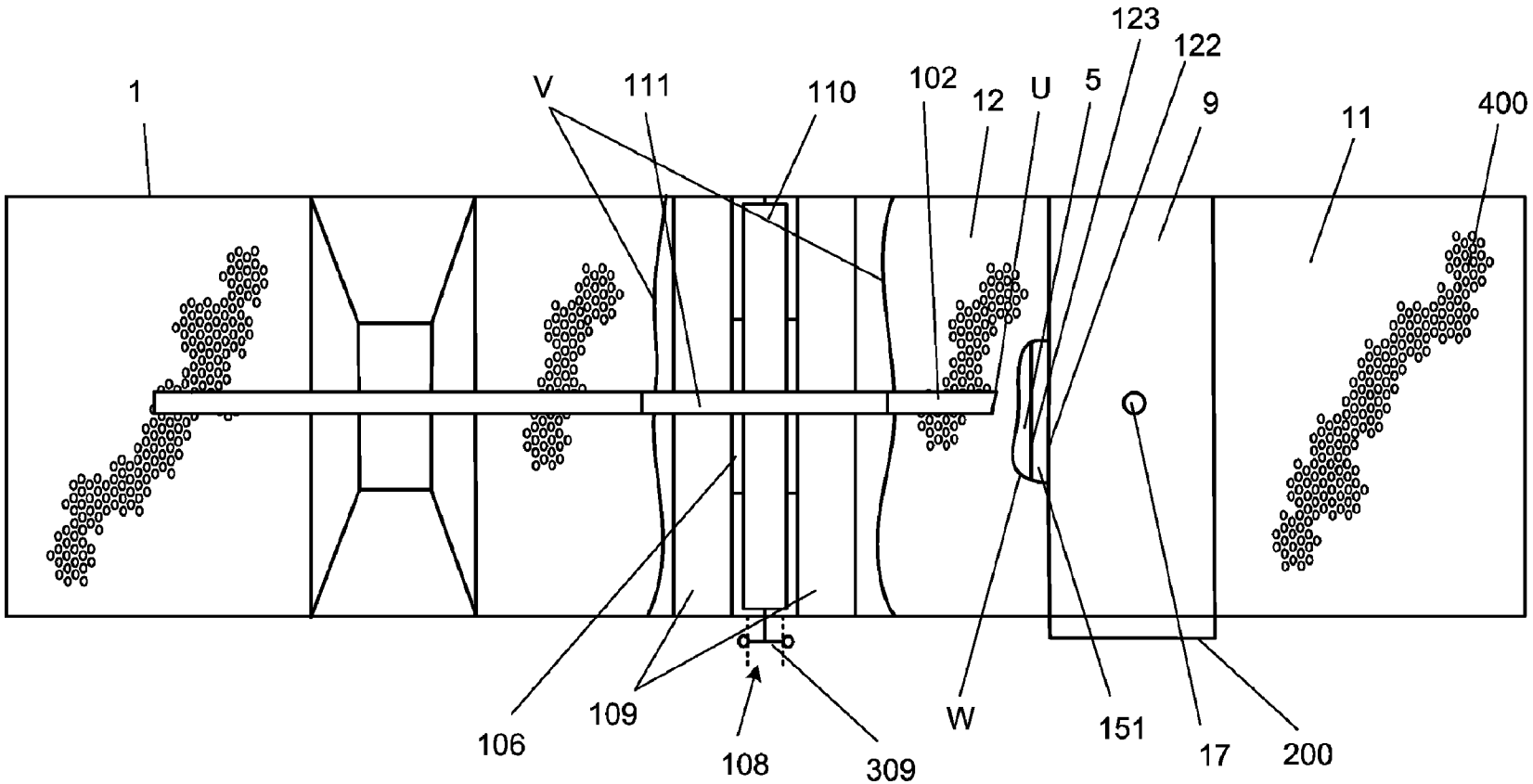
FIG. 4 is a top view of the first embodiment.

FIG. 4 is a top view of the first embodiment, with certain cutaways to improve the view of internal parts. All of the piping rightward of U has been removed to better reveal lower structure. Hole 17 through floor 5 is centered above a matching hole in rigid product dryer gate 9. Cutaway W is provided to reveal a portion of slot 151, formed between the left edge 122 of rigid product dryer gate 9 and upper edge 123 of hopper chute 8 (not shown). Slot 151, spanning most of the width of box 1, allows air to pass beneath center perforated bottom 12 into hopper air space 124 (not shown) and on through a similar slot 152 (hidden by right perforated bottom 11 in this view). This allows air to pass from hopper air space 124 into the air space 13 (not shown) beneath right perforated bottom 11.

The perforated bottoms 11 and 12 (and their mirror images on the other end of the trailer) are denoted by depictions here of some of their perforations 400. The perforations are normally of even size and distribution, but they may be distributed in gradations of count per square foot or of hole size over the surfaces of the bottoms to provide particular default or uncontrolled (dampers fully open) drying air distribution.

Perforated bottom 12 and its mirror image piece to its left have been cut away at V to show the structure of damper 110 and baffles 109 below them. Damper 110 is partially open (as in FIG. 1) partially revealing air access hole 106.

Figure 5:
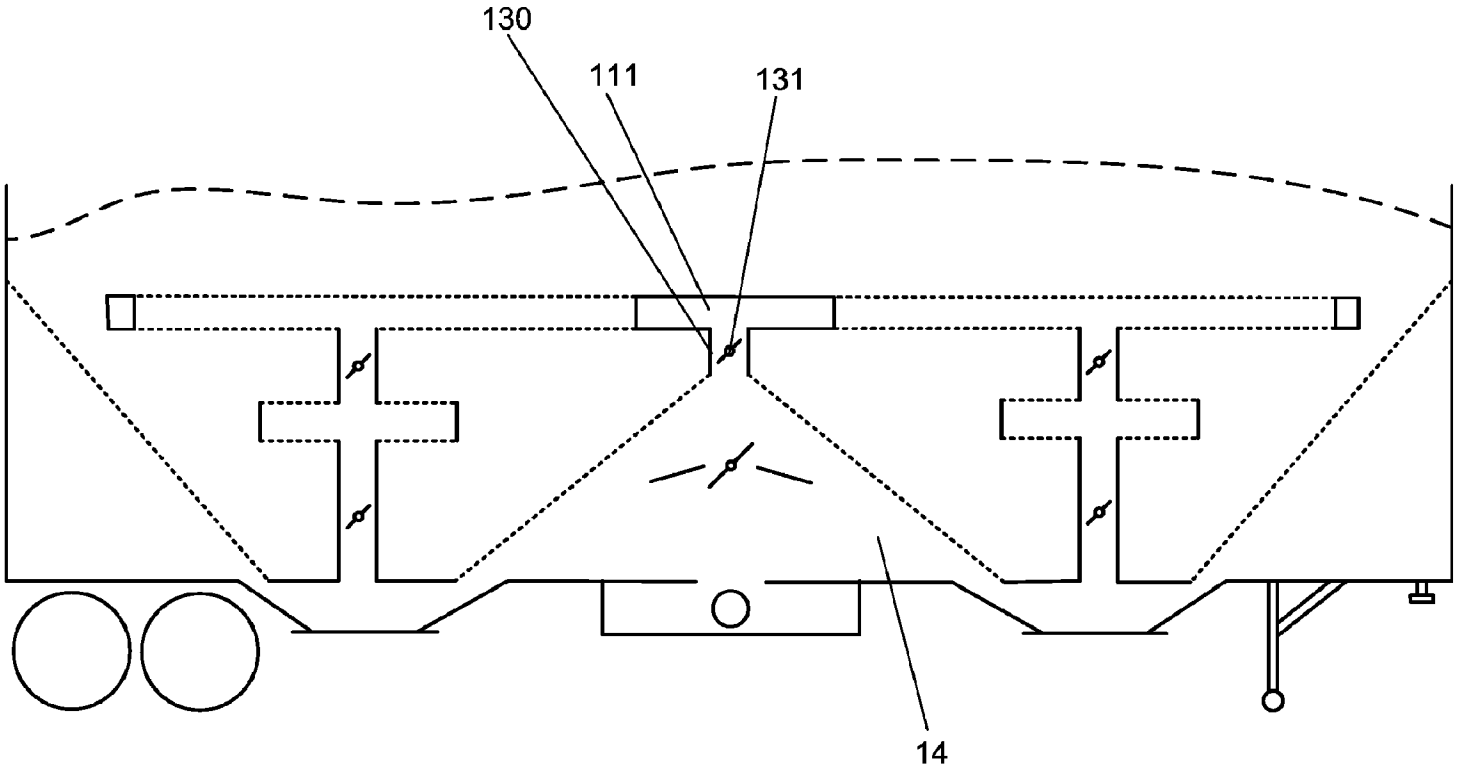
FIG. 5 is a side cutaway view of a second embodiment.

FIG. 5 is a side cutaway view of a second embodiment of the invention, identical to the first embodiment depicted in FIG. 1 and described variants, with the added feature of riser 130. Riser 130 connects space 14 with non-perforated pipe 111 and provides another way of changing air distribution within the invention. Riser damper 131 may optionally be provided to regulate air flow through the riser.

Figure 6:
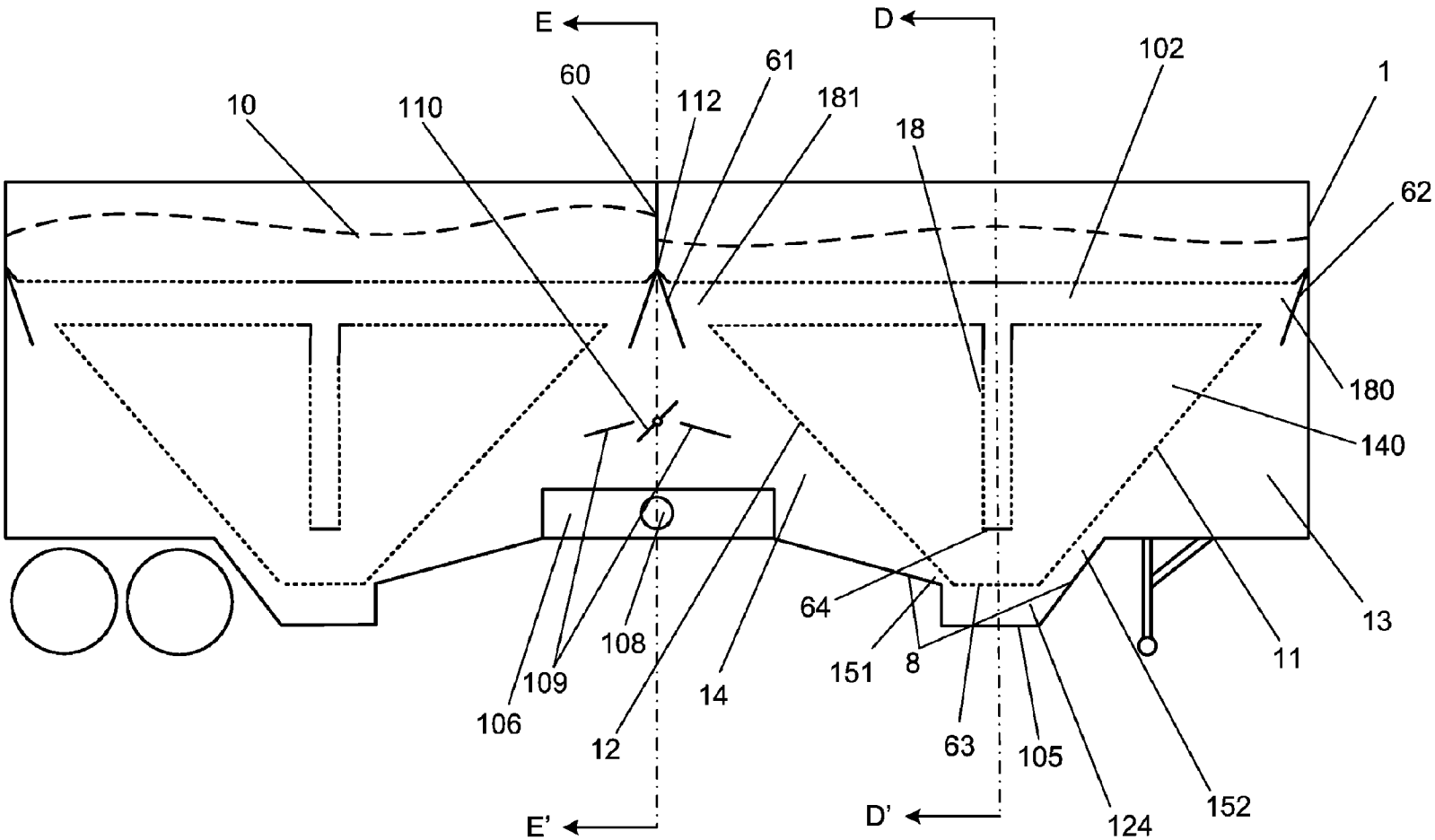
FIG. 6 is a side cutaway view of a third, preferred, embodiment.

FIG. 6 is a side cutaway view of a third, preferred, embodiment of the present invention installed in a typical semi-trailer. As in the first and second embodiments, the components of the drying apparatus internal to the box 1 are essentially two identical halves, each of which is a mirror image of the other. Most of the essential detail of the invention is shown in the right half of FIG. 6. The principal difference between this embodiment and the first two is the flow path of the air and the means of its apportionment. Rather than having air pass from space 14 through slot 151 into the lower end of vertical pipe 18, it passes into upper perforated pipe 102 though holes 180 and 181 near the upper ends of bottoms 11 and 12 respectively, and thence downward into the upper end of vertical pipe 18. In this embodiment, upper perforated pipe 102 serves as a header branching into vertical pipe 18 instead of the other way around. As in the first two embodiments, air can still move from space 14 through slot 151 into hopper air space 124, thence through slot 152 into air space 13. The apportionment of air into upper perforated pipe 102 and vertical pipe 18 is regulated by dampers 61 and 62 instead of dampers 103, 104, and 110. Vertical pipe 18 has a cap 64 at its lower end in this embodiment, rather than being connected to air space 124. This air flow pattern allows lower perforated pipe 101 (see FIGS. 1 and 5) to be eliminated.

The preferred embodiment optionally replaces bottom plenum 107 and circular bottom air hole 106 (FIGS. 1 and 5) with rectangular side air plenum 107 feeding directly into air space 14. Another preferred option is a partition extending vertically from upper edge 112 of perforated bottom 12 for the purpose of preventing agricultural product from flowing from a full drying zone 140 into an empty one on the other side of the partition.

In this preferred embodiment, rigid product dryer gate 9 of FIGS. 1 and 5 is also optionally, but preferably, replaced with a perforated flexible gate 63 (more clearly illustrated in FIGS. 7 and 8 below).

Figure 7:
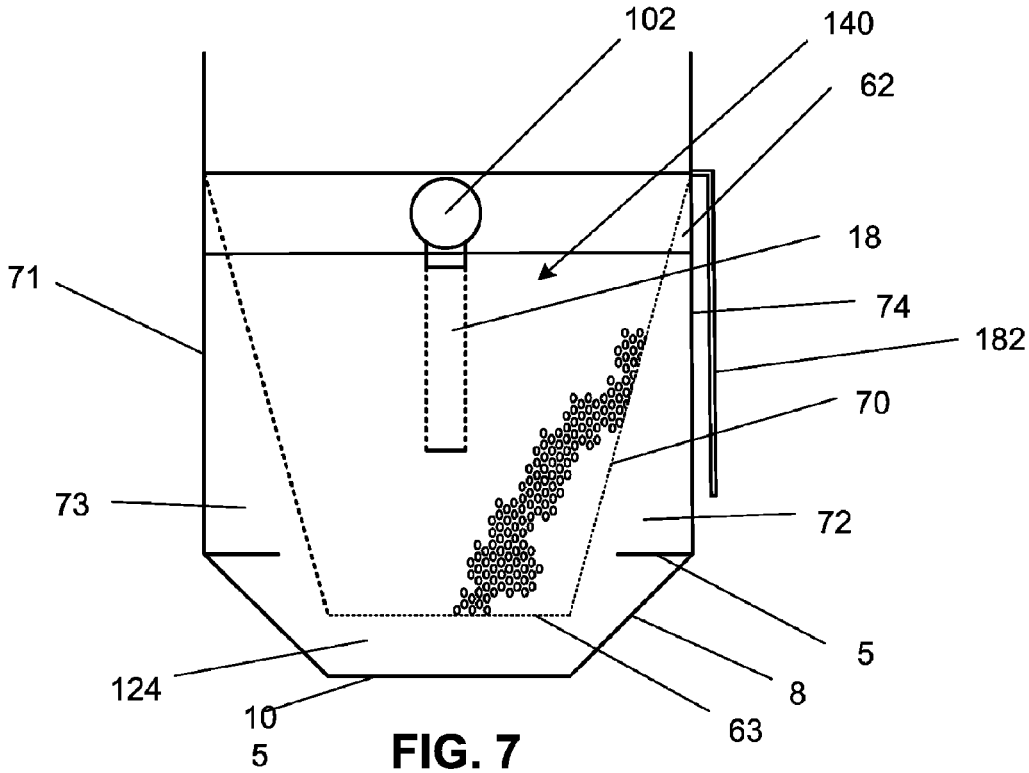
FIG. 7 is section view D-D' of the preferred embodiment.

FIG. 7 is section view D-D' of the preferred embodiment. Note that the principal changes from the first and second embodiments is that the rigid product dryer gate 9 (FIGS. 1 and 5) has been replaced by perforated flexible gate 63; that vertical pipe 18 no longer communicates with hopper air space 124, and that lateral perforated bottoms 70 and 71 have been provided at an angle from trailer side walls 74 and 75, allowing air to circulate all the way around drying zone 140 through side air spaces 72 and 73. Further, the only damper in this view is 62, which regulates flow of air into upper perforated pipe 102 from the ends of the trailer.

Figure 8:
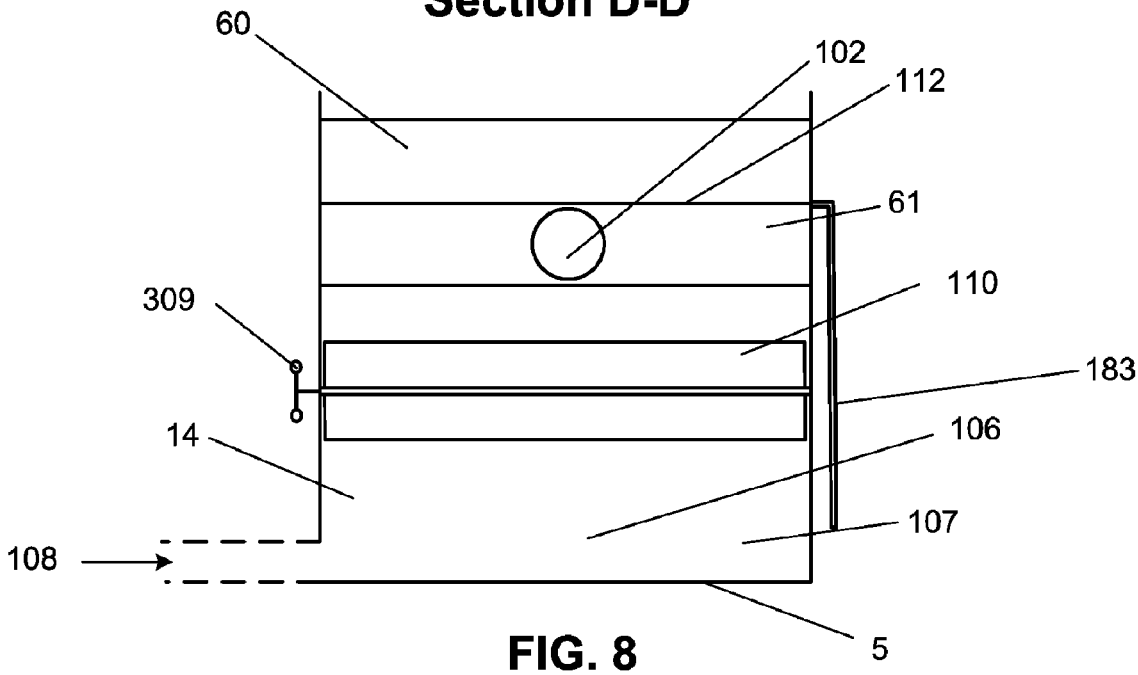
FIG. 8 is section view E-E' of the preferred embodiment.

FIG. 8 is section view E-E' of the preferred embodiment, at the centerline of the trailer. The principal differences here are the positioning of upper perforated pipe 102 below the upper edges 112 of the middle perforated bottoms (ref. 12 in FIGS. 1 and 5), the placement of damper 62 in such a way as to regulate the flow of air into upper perforated pipe 102 from the center of the trailer, and the installation of partition 80 to prevent spillage of product from one end of the trailer into the other.

Figure 9:
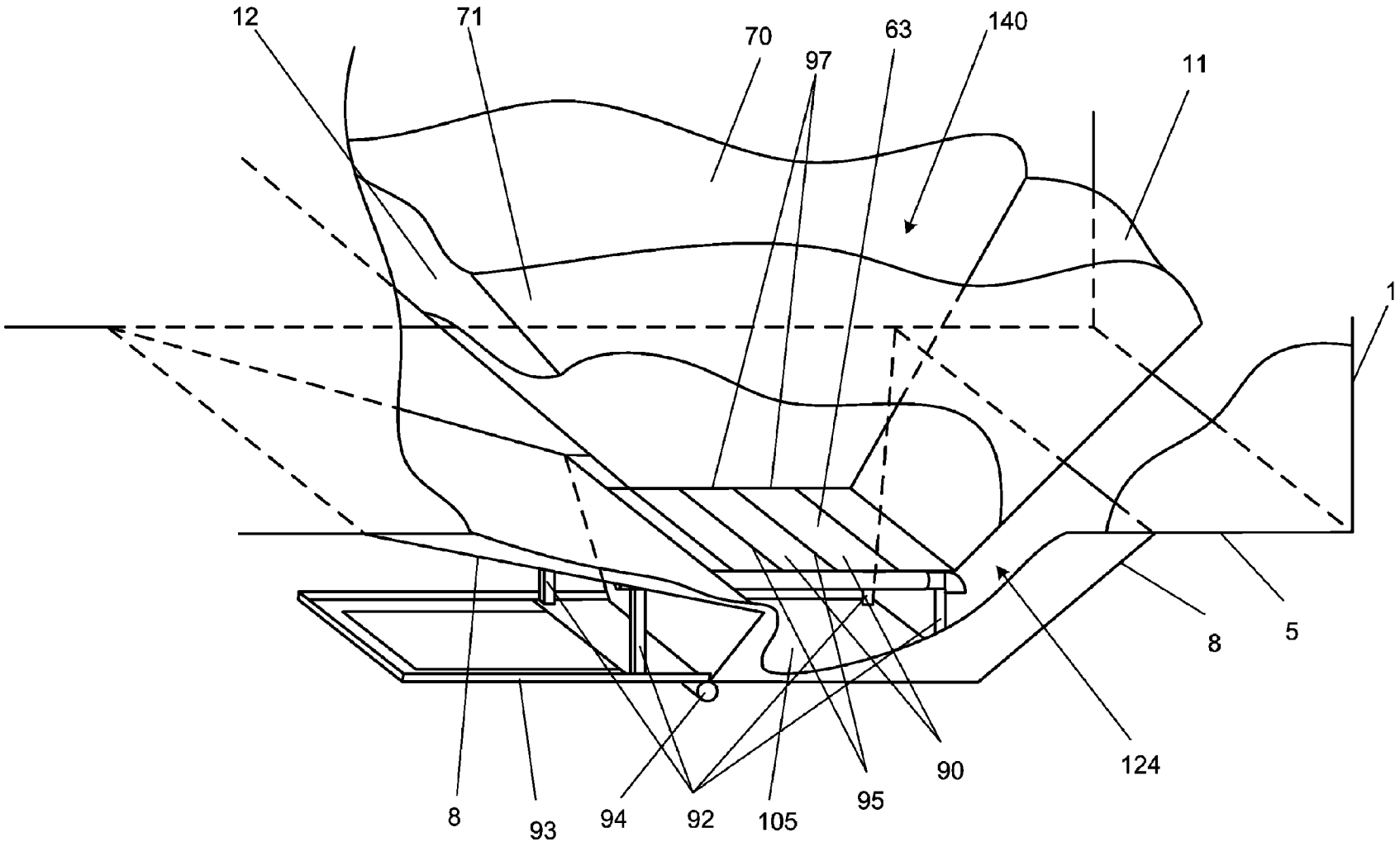
FIG. 9 is a cutaway perspective view of the hopper and dryer gate structure of the preferred embodiment, the gates being closed.

FIG. 9 is a cutaway perspective view of the gate and hopper structure of the preferred embodiment, hopper gate 105 and flexible gate 63 being closed. Hopper chute 8 is an essentially inverted truncated pyramidal structure below bottom 5 of trailer box 1, which, with hopper gate 105 below and flexible gate 63 above, defines hopper air space 124. Above space 124 is product drying zone 140, another essentially inverted truncated pyramidal structure defined by flexible gate 63 at its lower end, open at its upper end, and surrounded by perforated bottoms 11, 12, 70, and 71. Flexible gate 63 retains agricultural product within drying zone 140.

Flexible gate 63 further comprises perforated panels 90, joined by hinges 95. When the gate 63 is closed as shown, a proximal horizontal bar 91 holds up proximal ends 96 of panels 90. (A distal horizontal bar, not visible, holds up the distal ends 97 of panels 90.) The horizontal bars are held rigidly above and affixed to hopper gate 105 by vertical struts 92 at the four corners of hopper gate 105. Hopper gate 105 is opened by turning pinions 94 counterclockwise, causing gate 105 to slide to the left within gate support frame 93.

Figure 10:
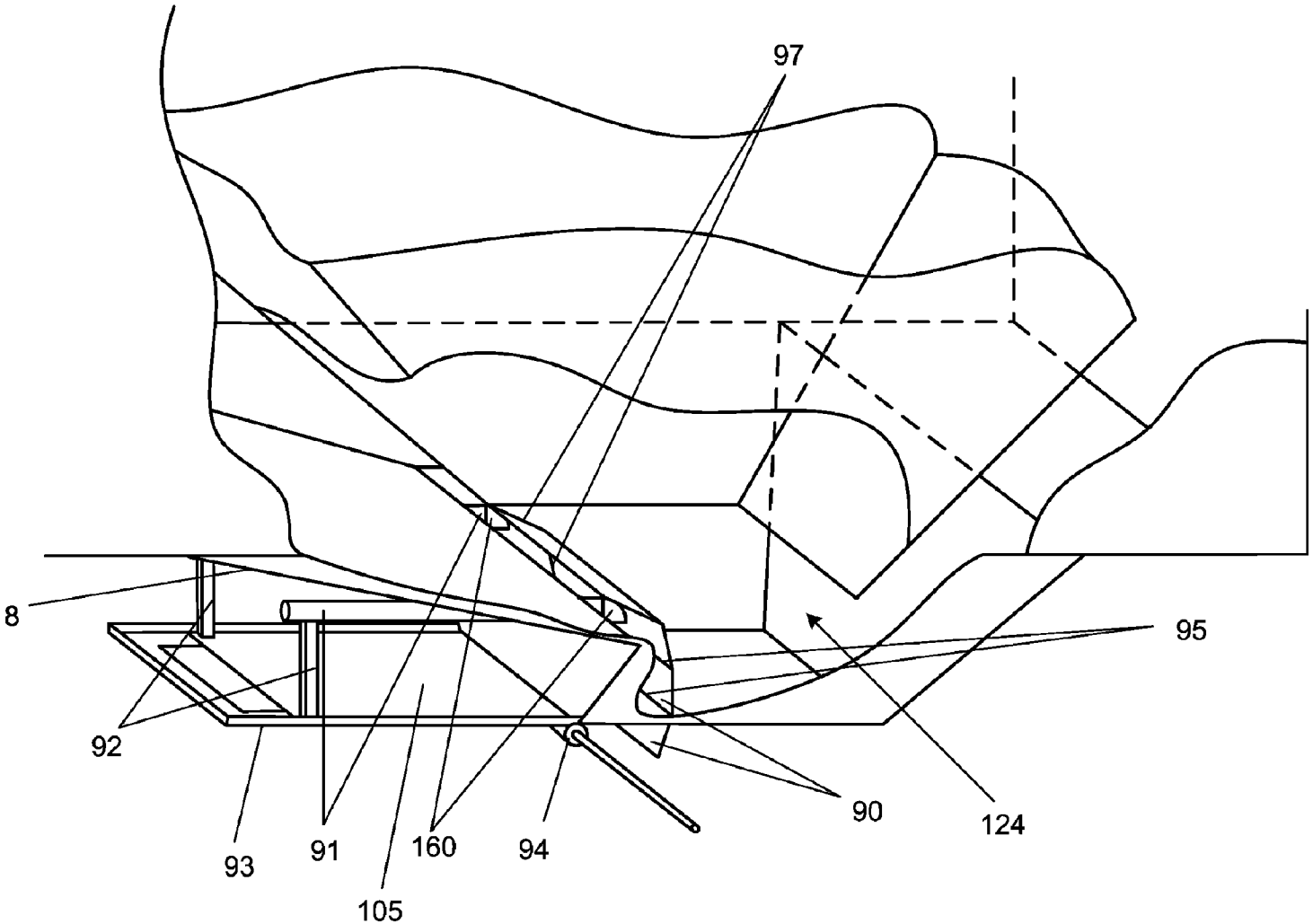
FIG. 10 is a cutaway perspective view of the hopper and dryer gate structure of the preferred embodiment, the gates being open.

FIG. 10 is a cutaway perspective view of the gate and hopper structure of the preferred embodiment, hopper gate 9 and flexible gate 63 being open. Hopper gate 105 is shown fully withdrawn to the left. Because struts 92 are rigidly attached to it, they have pulled bars 91 to the left. With bars 91 no longer beneath them for support, panels 90 of flexible gate 63 fall down, rotating about their hinges 95 in a clockwise direction. This allows product to exit drying space 140 through hopper space 124. When it is desired to close both gates, pinion 94 is rotated clockwise, moving both hopper gate 105 and bars 91 to the right. Cams 160, mounted on the right ends of bars 91, push upwardly on ends 96 and 97 of panels 90, lining them up again in a horizontal plane.

The principal advantage of this flexible gate arrangement to release the product, over a sliding gate arrangement, is that it circumvents the enormous friction a sliding gate encounters under the weight of the product above. In the prior art, when it is desired to open a trailer containing peanuts above a single hopper slide gate, it is not unusual to have to hammer the gate open. The advantage of the flexible gate over a drop gate, i.e., a single horizontal panel hinged along one edge, is that it is less likely to warp upon closing due to remnants of product at its edge, and in this double-gate application it need not be closed separately before the hopper gate is closed.

The flexible gate described above is believed to be novel in its own right. Rollers, wheels, or other bearings may be used in place of cams within the scope of this invention; the novelty is in the sequential, rotational, raising and lowering of the panels. The use of fixed cams is the simplest and most economical choice for moving the panels. To use cams, however, special and novel geometry among the panels, hinges, and cams is necessary for greatest reliability.

Figure 11:
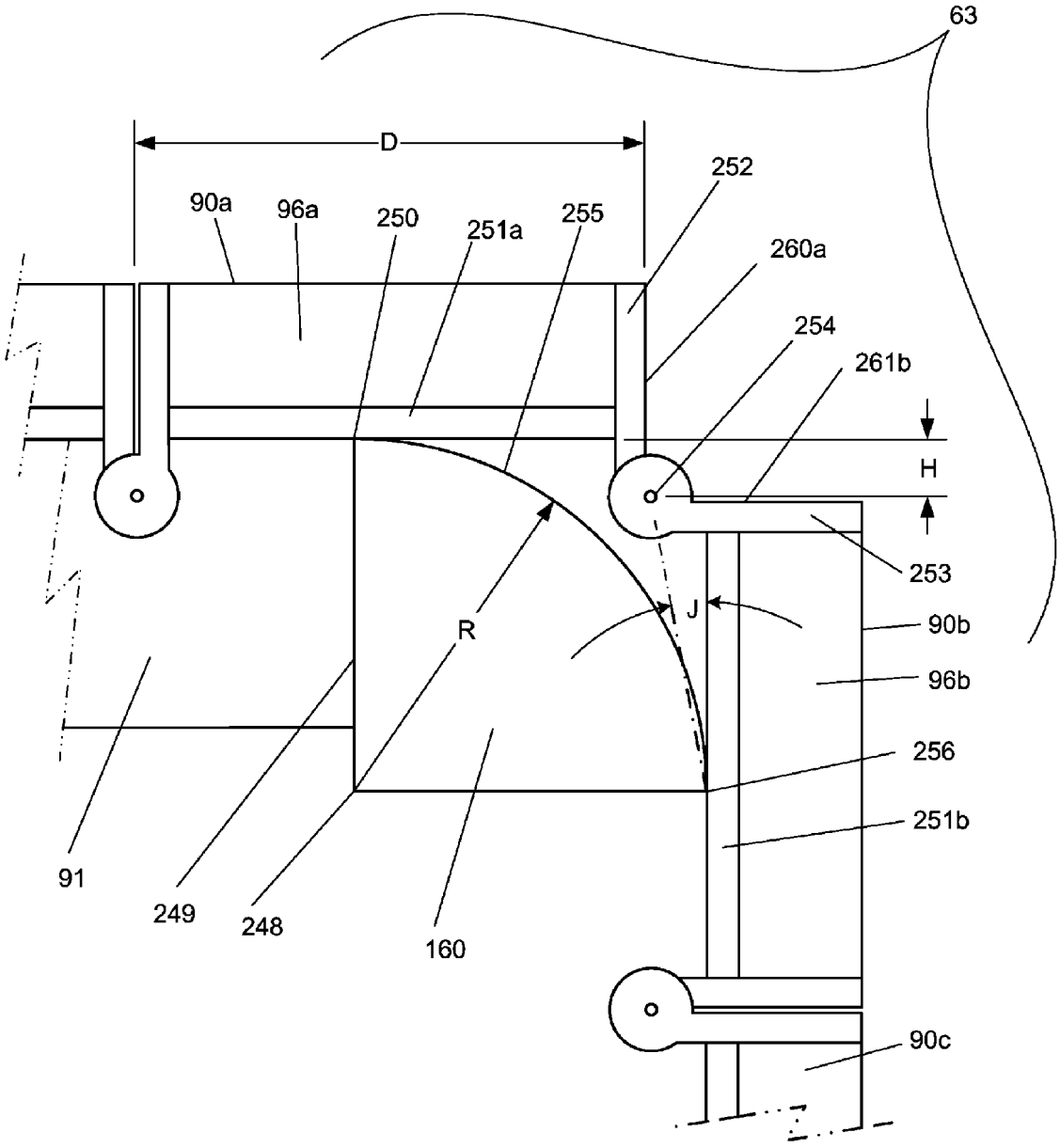
FIG. 11 is a side view of a portion of the dryer gate structure.

FIG. 11 is a side view of a portion of flexible gate 63, showing details of proximal ends 96 of two panels 90, hinges 95, proximal horizontal bar 91, and a cam 160 all necessary for reliable operation of the gate. These components, how they cooperate, and their relative positioning and relative dimensions are believed to be novel in their own right and have applicability to other hopper opening and closing applications, independent of drying and regardless of whether the panels 90 are perforated. Insofar as all motion of the flexible gate 63 and other parts is in the plane of the paper, FIG. 11 shows not only the proximal ends 96 of two panels 90, but also, superimposed on that, a side view of a hinge 95 joining the two. (The hinge 95 is mounted between the panels roughly midway between the proximal ends 96 and the distal ends 97 (not shown) of panels 90, and is therefore not in the same plane as the cam.) The corresponding distal parts of the flexible gate operate in identical manner in a mirror image of what is shown.

Cam 160 is shown supporting left panel 90*a* horizontally and moving from left to right, operating to close the flexible gate 63. Cam 160 is a quarter-circle of rigid material affixed to the right end 249 of proximal horizontal bar 91. The top edge 250 of cam 160 supports end track 251*a*, fixed to the underside of proximal end 96*a* of panel 90*a*. Left strap 252 of hinge 95 is forms the front (right end in this view) 260*a* of panel 90*a*, and right strap 253 of hinge 95 forms the rear (top end in this view) 261*b* of panel 90*b*. The two hinge straps 252 and 253 are joined to, and revolve about, hinge pin 254. Hinge pin 254 extends horizontally into the plane of the paper. Cam 160 has advanced to the right just enough to contact end track 251*b* on the underside of proximal end 96*b* of panel 90*b*. It can be visualized that as cam 160 moves to the right, panel 90*b* will be rotated about the center of pin 254, eventually raising panel 90*b* upward until panel 90*b*, too, is horizontal. At that point, hinge straps 252 and 253 will be substantially parallel and vertical. It can also be visualized that the arcuate portion 255 of cam 160 must be smooth from its forward edge 256 to its top edge 250 to lift panel 90*b* smoothly from vertical to horizontal.

What is less easily visualized perhaps is that the position of pin 254 relative to the cam surface 255 and to tracks 251*a* and 251*b* is critical. It has been found by experimentation that pin 254 must be below the plane of track 251*a* and its center must be directly beneath the center of the space between hinge strap 252 and strap 253 (when strap 253 is fully raised). Another way of saying this is that the center of pin 254 must lie substantially on a 45° angle from vertex 248. This is necessary because if the pin 254 is not at that location, the top edge 250 of cam 160 will be unable to push panel 90*b* into a horizontal position as it nears the front 260*a* of panel 90*a*. Further, the ratio $C_1$—the radius R of cam 160 divided by the distance H from the bottom surface of track 251*a* to the to center of pin 254—must be no less than 5.9 and no greater than 6.7. In other words, the forward edge 256 of cam 160 must lead pin 254 by an angle J between 10 degrees and 12 degrees. It has been found by experimentation that this is necessary to prevent binding of track 251*b* against forward edge 256 of cam 160 as the lifting of panel 90*b* commences, and to minimize frictional drag between the track 251*b* and arcuate portion 255 of cam 160 as panel 90*b* rotates. It has also been found by experimentation that the ratio $C_2$—the radius R of cam 160 divided by the distance D between front edges of panels 90—should be in the range of 0.65 to 0.75. The reason for this is that if the ratio $C_1$ is significantly below this range, the forward edge 256 of cam 160 has so little leverage in rotating panel 90*b* around pin 254 that the mechanism binds, and the top edge 250 of cam 160 arrives at the rear 261*b* of panel 90*b* too soon to support panel 90*b*. If the ratio $C_1$ is too high, the forward edge 256 of cam 160 arrives at the next panel 90*c* too soon.

Figure 12:
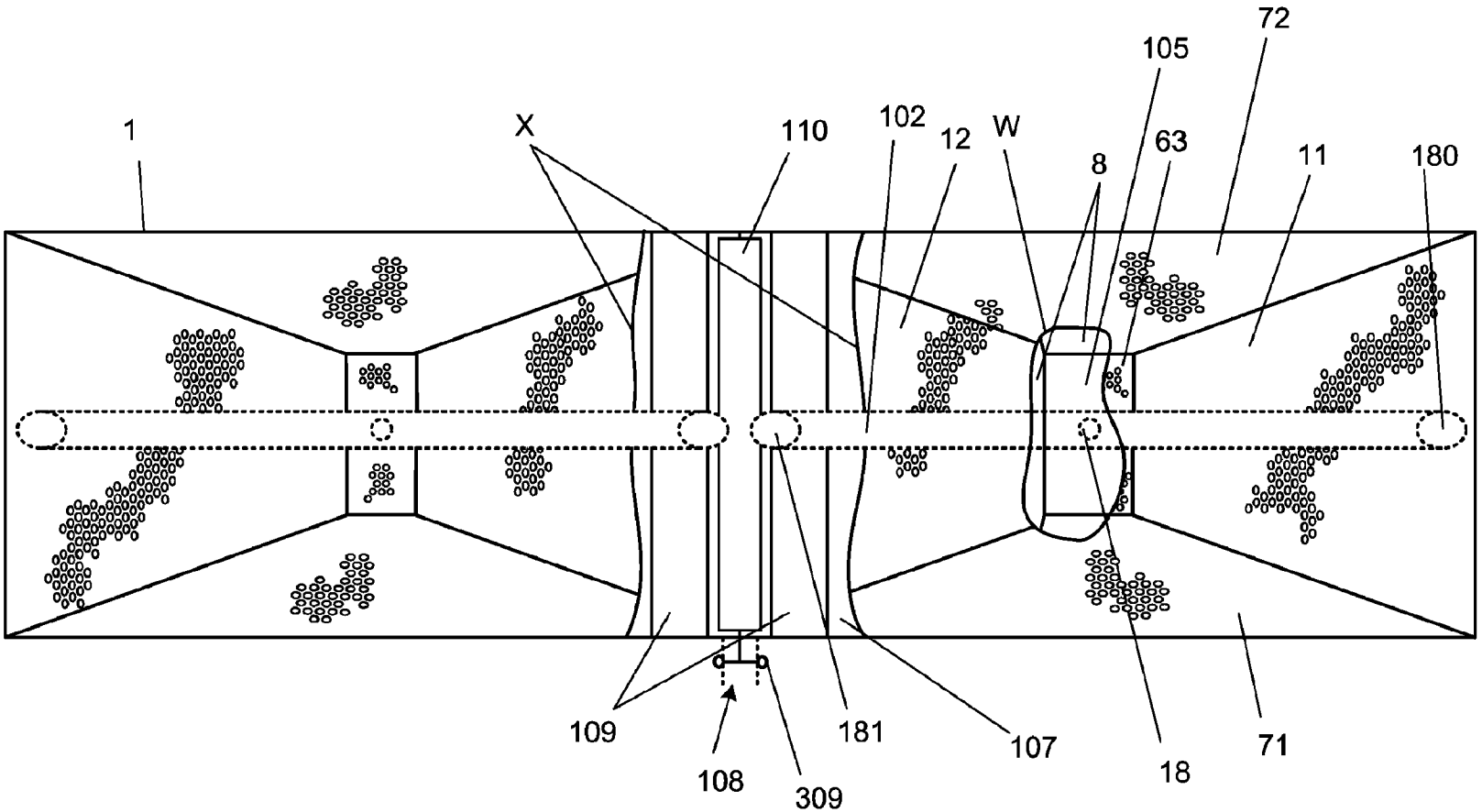
FIG. 12 is a top cutaway view of the preferred embodiment.

FIG. 12 is a top cutaway view of the preferred embodiment of the dryer apparatus. Readily visible in this view through the open top of container box 1 are perforated bottoms 11, 12, 70 and 71, as well as flexible gate 63. Cutaway W through those parts reveals hopper 8 and hopper gate 105. Also shown in small dashes for additional clarity are horizontal pipe 102 with its inlet holes 180 and 181, respectively, through bottoms 11 and 12. Vertical pipe 18 can be seen depending from horizontal pipe 102. Cutaways X reveal optional baffles 109 and middle damper 110 (with its hand wheel 309). Warm air source 108 can be seen feeding air into plenum area 107.

A fourth embodiment of this invention, not separately drawn, is a kit containing the internal trailer parts of the first and second embodiments, to be retrofitted to existing agricultural trailers. Referring now to the right half of FIGS. 1 and 5 and FIGS. 2 and 3, this fourth embodiment includes at least perforated bottoms 11 and 12, hopper chute 8, gates 9 and 105, vertical pipe 18, upper and lower perforated pipes 102 and 101, respectively, upper and lower dampers 104 and 103, respectively, and upper and lower hand wheels 204 and 203, respectively, and their linkages to the dampers 104 and 103.

A fifth embodiment of the invention (not shown) for longer trailers, includes two or more kits as described in the preceding paragraph describing the fourth embodiment, plus a non-perforated pipe 111 to connect the upper perforated pipes 102. Also included in this embodiment would optionally be a middle damper 110 and a pair of baffles 109.

A sixth embodiment of this invention, not separately drawn, is a kit containing the internal trailer parts of the third, preferred, embodiment, to be retrofitted to existing agricultural trailers. Referring now to the right half of FIG. 6 and FIGS. 7, 8, 9 and 10, this sixth embodiment includes at least perforated bottoms 11, 12, 71, and 72, header 102 and vertical pipe 18, dampers 61 and 62, and flexible gate 63 and its component parts. Optionally also included would be baffles 109, middle damper 110, hopper chute 8, hopper gate 105, and partition 60.

While dimensions are not critical to the utility of this invention, useful dimensions for the first and second embodiments on a typical 48' semi-trailer having a wall height of 10' are noted as follows: height of upper edge 112 of perforated bottoms above floor, 5'; height of bottom of upper perforated pipe 102 above floor, 6'; length of one-half of lower perforated pipe 101 measured from centerline of vertical pipe 18, 42"; length of one-half of upper perforated pipe 102 measured from centerline of vertical pipe, 84".

Useful dimensions of the preferred third embodiment on the same trailer are: height of upper edge of perforated bottoms above floor, 6'; Height of bottom of upper perforated pipe above floor, 5'; downward length of vertical pipe 18, 4.5'; diameter of upper perforated pipe, 12"; diameter of vertical pipe, 8"; Distance D=8"; Height H=⅞"; and radius R=5.5".

Tests on these embodiments indicate a preferred range of diameters for perforations 400 in the pipes and bottoms of between 1/16 inch and ¼ inch, spaced so as to provide between 30% and 50% open area in the pipes and bottoms.

This invention also includes a method for installing the kits described above in a box trailer having no bottom outlets, i.e., a flat bottom. For a shorter trailer, the method includes, at least, the steps (not necessarily in this order) of: a) cutting a rectangular hole in floor 5 to receive rigid product dryer gate 9; b) welding into place perforated bottom plates 11 and 12; c) cutting vertical pipe hole 17 in floor 5 and a matching hole in rigid product dryer gate 9; d) assembling the air manifold comprising pipes 18, 101, and 102, and dampers 103 and 104; e) welding the vertical pipe 18 onto vertical pipe hole 17; f) fabricating and welding into place hopper chute 8 beneath rigid product dryer gate 9; and g) connecting hand wheels 203 and 204 through the walls of box 1 to dampers 103 and 104, respectively.

For a longer trailer in which it is desired to install two kits as shown in FIGS. 1 and 5, a) cut air entry hole 106 in the center of the floor 5 of the trailer; b) install middle damper 110 and baffles 109 across the center of the trailer; d) go through the steps in the preceding paragraph at both ends of the trailer; e) weld non-perforated pipe 111 to opposing ends of upper perforated pipes 102 and to both upper edges 112 of both middle perforated bottoms 12; and f) weld air plenum 107 into place below air entry hole 106.

To install a single iteration of the preferred embodiment, the steps of the installation method (not necessarily in this order) include: a) cutting a rectangular hole in floor 5 to receive hopper chute 8; b) welding into place perforated bottom plates 11, 12, 71 and 72; c) cutting horizontal pipe holes 180 and 181; d) assembling the air manifold comprising pipes 18 and 102; e) installing the air manifold over holes 180 and 181; f) fabricating and welding into place hopper chute 8 over floor hole 5; g) assembling product dryer flexible gate 63; h) installing flexible gate 63 at the bottom of plates 11, 12, 71 and 72; i) installing dampers 61 and 62 over holes 180 and 181; j) connecting damper levers 182 and 183 through the walls of box 1 to dampers 61 and 62 respectively; and k) cutting an air entry hole 106 into container box 1.

For a longer trailer in which it is desired to install two of the preferred third embodiment, it is necessary merely to install two of the single iterations as described in the last paragraph, with optional additional step of l) installing vertical partition 60, horizontal baffles 109, middle damper 110, and middle damper hand wheel 309.

The present invention further includes a method for drying agricultural product using the above-described embodiments, including the steps of: a) closing the rigid product dryer gate 9 (or flexible product dryer gate 63); b) filling drying zone(s) 140 with un-dried agricultural product; c) attaching warm air source 108 to plenum 107 and turning it on; and d) adjusting damper levers 182, 183 and hand wheel 309 to optimal positions for even drying in accordance with experience or desired sensor outputs; e) continuing the drying operation for a measured period of time or achievement of specified sensor outputs; f) turning off the warm air source 108; and g) opening the product dryer gate 9 (or flexible gate 63).

What is claimed is:

1. An agricultural product drying apparatus for the substantially rectangular container box of a transport vehicle, comprising:

a product dryer for holding bulk agricultural product;

the product dryer having an upper end with an upper periphery, a lower end, and sloping, perforated sides, the upper end having a larger cross section than the lower end;

the lower end having an openable and re-closable product dryer gate;

the sloping sides and product dryer gate forming the outer surface of the product dryer;

at least one header pipe extending from the outer surface into the interior of the product dryer;

the at least one header pipe being perforated along at least a portion of its length;

means for introducing air through the outer surface;

means for introducing air into the at least one header pipe;

means for apportioning the air between the outer surface and the at least one header pipe;

the means for introducing air through the outer surface comprising fixing the upper end of the product dryer to the vertical walls of the container box along the entirety of the periphery, and introducing air into the container box at a point below the periphery;

the means for introducing air into the at least one header pipe comprising fixing at least one open end of the at least one header pipe to, and through, at least one specific location on the outer surface of the product dryer;

at least one of the at least one header pipes dividing into at least one perforated branch pipe within the product dryer;

the means for variably restricting air flow into the at least one header pipe comprising at least one hinged damper positioned so as to variably block entry of air into the at least one specific location;

the lower end and the product dryer gate being rectangular and congruent, the product dryer gate having a left edge and a right edge, the left edge being attached by a first hinge to the congruent edge on the lower end;

the product dryer gate being subdivided into a number n of rectangular panels, each panel having left and right edges equal in length to the width of the dryer gate, and having opposing front and back edges, the panels being arrayed substantially parallel to each other and to the first hinge and being joined together left to right by n−1 secondary hinges;

the product dryer portion of the apparatus being fixed in a container box having a hopper chute built into the bottom of the container box and having a horizontal hopper gate affixed to the lower end of the hopper chute;

a means for opening and closing the horizontal hopper gate and the product dryer gate simultaneously in a single motion comprising front and back horizontal bars, each bar having a left end and a right end;

the horizontal bars further comprising cams at the right ends;

the horizontal bars being slidingly mounted in holes through the left side of the hopper chute;

the left ends of the horizontal bars being outside the hopper chute and the right ends of the horizontal bars being inside the hopper chute;

the right ends of the horizontal bars being supported rigidly and vertically above the right end of the sliding hopper gate by struts inside the hopper chute, the struts having a vertical extent above the sliding hopper gate;

the left ends of the horizontal bars being supported rigidly and vertically above the left end of the sliding hopper gate by struts outside the hopper chute, the struts having a vertical extent above the sliding hopper gate;

the vertical extent being sufficient to position the horizontal bars and the cams into sliding contact with the panels of the product dryer gate when the product dryer gate is in contact with the lower end; and the cams lowering the panels from right to left when the bars are retracted to the left and raising the panels from left to right when the bars are extended to the right.

2. The apparatus of claim 1, wherein:

said panels are perforated.

3. The apparatus of claim 2, wherein:

said at least one header pipe is a horizontal pipe running from one side of said product dryer to the other, the horizontal pipe having a branch pipe depending vertically from the center of said horizontal pipe and extending downward toward, and terminating above, said product dryer gate.

4. The apparatus of claim 2, further comprising:

the container box itself, the container box having a preexisting hopper chute and hopper gate.

5. The apparatus of claim 2, further comprising:

a hopper chute and hopper gate for rigid attachment to a container box having no bottom outlets, the attachment effected by cutting a hole in the bottom of the container box and affixing the hopper chute to the container box.

6. The apparatus of claim 5, further comprising:

said container box having no bottom outlets.

7. An agricultural product drying apparatus for the substantially rectangular container box of a transport vehicle comprising:

a product dryer for holding bulk agricultural product;

the product dryer having an upper end with an upper periphery a lower end, and sloping, perforated sides, the upper end having a larger cross section than the lower end;

the lower end having an openable and re-closable product dryer gate;

the sloping sides and product dryer gate forming the outer surface of the product dryer;

at least one header pipe extending from the outer surface into the interior of the product dryer;

the at least one header pipe being perforated along at least a portion of its length;

means for introducing air through the outer surface;

means for introducing air into the at least one header pipe;

means for apportioning the air between the outer surface and the at least one header pipe;

the means for introducing air through the outer surface comprising fixing the upper end of the product dryer to the vertical walls of the container box along the entirety of the periphery and introducing air into the container box at a point below the periphery;

the means for introducing air into the at least one header pipe comprising fixing at least one open end of the at least one header pipe to, and through, at least one specific location on the outer surface of the product dryer;

at least one of the at least one header pipes dividing into at least one perforated branch pipe within the product dryer;

the specific location being the product dryer gate;

the at least one header pipe being one vertical header pipe extending upward into the interior of the product dryer;

the means for variably restricting air flow into the vertical header pipe comprising a damper inside the entry into the vertical header pipe;

the at least one perforated branch pipe being an upper horizontal pipe having caps at either end, and being attached at its midpoint to the top of the vertical header pipe, and a lower horizontal pipe having caps at either end, and being attached at its midpoint to the midpoint of the vertical header pipe; and the means for apportioning the air between the upper horizontal pipe and the lower horizontal pipe being a damper installed in the vertical header pipe above the lower horizontal pipe and below the upper horizontal pipe.

8. The apparatus of claim 7, further comprising:

the container box itself, the container box having a preexisting hopper chute and hopper gate.

9. The apparatus of claim 7, further comprising:

a hopper chute and hopper gate for rigid attachment to a container box having no bottom outlets, the attachment effected by cutting a hole in the bottom of the container box and affixing the hopper chute to the container box.

10. The apparatus of claim 9, further comprising:

said container box having no bottom outlets.

11. An agricultural product drying apparatus, comprising:

a plurality m of the apparatuses of claim 7, concatenated by connecting the upper horizontal pipes of each apparatus end to end by a number m−1 of connector pipes.

12. The apparatus of claim 11, wherein:

at least one riser pipe is attached between at least one connector pipe and the space from below said apparatuses, at least one of the at least one riser pipes having a damper installed within it.

13. The apparatus of claim 11, further comprising:

the container box itself, the container box having a number m of preexisting hopper chutes and hopper gates.

14. The apparatus of claim 11, further comprising:

a number m of hopper chutes and hopper gates for rigid attachment to a container box having no bottom outlets, the attachment effected by cutting a number m of holes in the bottom of the container box and affixing the hopper chutes to the container box.

15. The apparatus of claim 14, further comprising:

said container box having no bottom outlets.

16. A method of drying agricultural products in the apparatus of claim 14, comprising the steps of:

a) closing said product dryer flexible gate;

b) filling said drying zone(s) with un-dried agricultural product;

c) attaching said warm air source to said dryer plenum and turning it on;

d) adjusting said damper levers and said hand wheel to predetermined positions;

e) continuing the drying operation until a predetermined condition of dryness is achieved;

f) turning off said warm air source; and g) opening said product dryer flexible gate.

* * * * *